US011746431B2

(12) United States Patent
Simakov et al.

(10) Patent No.: US 11,746,431 B2
(45) Date of Patent: Sep. 5, 2023

(54) METAL INERT ANODE FOR ALUMINUM PRODUCTION OF BY THE ELECTROLYSIS OF A MELT

(71) Applicant: OBSHCHESTVO S OGRANICHENNOY OTVETSTVENNOSTY YU "OBEDINENNAYA KOMPANIYA RUSAL INZHENERNO-TEKHNOLOGICHESKIY TSENTR", Krasnoyarsk (RU)

(72) Inventors: Dmitrij Aleksandrovich Simakov, Krasnoyarsk (RU); Aleksej Gennad'evich Burtsev, Krasnoyarsk (RU); Aleksandr Olegovich Gusev, Krasnoyarsk (RU)

(73) Assignee: OBSHCHESTVO S OGRANICHENNOY OTVETSTVENNOSTY YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 758 days.

(21) Appl. No.: 16/489,669

(22) PCT Filed: Feb. 20, 2018

(86) PCT No.: PCT/RU2018/050020
§ 371 (c)(1),
(2) Date: Aug. 28, 2019

(87) PCT Pub. No.: WO2018/160105
PCT Pub. Date: Sep. 7, 2018

(65) Prior Publication Data

US 2020/0115812 A1 Apr. 16, 2020

(30) Foreign Application Priority Data

Mar. 1, 2017 (RU) ..... 2017106835

(51) Int. Cl.
*C25C 1/00* (2006.01)
*C25C 3/12* (2006.01)
*C25C 3/06* (2006.01)

(52) U.S. Cl.
CPC . *C25C 3/12* (2013.01); *C25C 3/06* (2013.01)

(58) Field of Classification Search
CPC ..... C25C 3/12; C25C 3/06
See application file for complete search history.

(56) References Cited

U.S. PATENT DOCUMENTS 4,263,107 A 4/1981 Pellegri
5,015,343 A * 5/1991 LaCamera ..... C25C 7/025 205/382

(Continued)

FOREIGN PATENT DOCUMENTS

CA 2357717 A1 7/2000
CN 1735717 A 2/2006

(Continued)

OTHER PUBLICATIONS

Yakimenko, L.M.. , Elektrodnye materialy v prikladnoi elektrokhimii (Electrode Materials in Applied Electrochemistry), Moscow: Khimiya, 1977. (Russian with English translation of Table of Contents).

(Continued)

*Primary Examiner* — Zulmariam Mendez
(74) *Attorney, Agent, or Firm* — Baker & McKenzie LLP

(57) ABSTRACT

The design of a metal inert anode is proposed, it is made in the form of a perforated structure with through-openings, in particular formed by longitudinal and transverse anode elements intersecting each other and limited by the lateral sides of the intersecting anode elements, and contains ver- (Continued)

Figure 1:
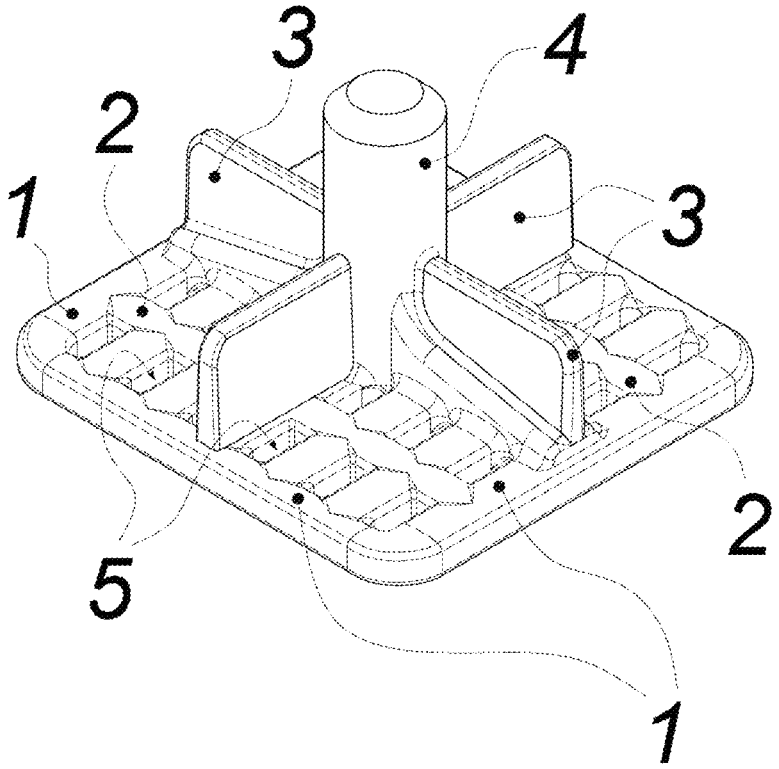

tical or inclined fins that protrude from the bath and are integrated with the anode elements or a current conductor. As a result, it ensures a reduction in the voltage drop in the anode and in the bubble layer under the anode, a reduction in the anode overvoltage and anode consumption, an increase in current efficiency and the reliability of the cryolite-alumina crust, which leads to an increase in the anode service life and promotes the formation of a reliable and durable cryolite-alumina crust above the melt surface, which improves process efficiency.

19 Claims, 1 Drawing Sheet

(56) References Cited

U.S. PATENT DOCUMENTS

| | | | |
|---|---|---|---|
| 5,368,702 | A | 11/1994 | De Nora |
| 6,402,928 | B1 | 6/2002 | De Nora et al. |
| 6,656,340 | B2 | 12/2003 | De Nora et al. |
| 6,723,221 | B2 | 4/2004 | D'Astolfo, Jr. et al. |
| 7,749,363 | B2 | 7/2010 | De Nora et al. |
| 2004/0163967 | A1 | 8/2004 | LaCamera et al. |
| 2006/0124471 | A1 | 6/2006 | Nguyen et al. |
| 2008/0041729 | A1 | 2/2008 | De Nora et al. |
| 2011/0100834 | A1 | 5/2011 | De Nora et al. |
| 2017/0362726 | A1 | 12/2017 | Gusev et al. |

FOREIGN PATENT DOCUMENTS

| | | | |
|---|---|---|---|
| CN | 104797743 | | 7/2015 |
| RU | 2242539 | C2 | 12/2004 |
| RU | 2318924 | C2 | 3/2008 |
| RU | 2374362 | C2 | 11/2009 |
| RU | 2582421 | C1 | 4/2016 |
| SU | 1364243 | A3 | 12/1987 |
| WO | 2000040781 | A1 | 7/2000 |
| WO | 2000040782 | A1 | 7/2000 |
| WO | 2002070784 | A1 | 9/2002 |
| WO | 2003074766 | A1 | 9/2003 |
| WO | 2003006716 | A3 | 6/2004 |
| WO | 2004104273 | A1 | 12/2004 |

OTHER PUBLICATIONS

International Search Report of International Searching Authority ROSPAT, in corresponding International Application No. PCT/RU2018050020, dated Jun. 14, 2018. (Original Russian and English translation).

International Written Opinion of International Searching Authority ROSPAT, in corresponding International Application No. PCT/RU2018050020, dated Jun. 14, 2018. (Original Russian and English translation).

* cited by examiner

METAL INERT ANODE FOR ALUMINUM PRODUCTION OF BY THE ELECTROLYSIS OF A MELT

CROSS-REFERENCE TO RELATED APPLICATIONS

This application is a U.S. National Stage entry of and claims priority to PCT Application No. PCT/RU2018/050020 filed Feb. 20, 2018, which itself claims priority to Russian Patent Application No. 2017106835 filed Mar. 1, 2017. The contents from all of the above are hereby incorporated in their entirety by reference.

The invention relates to non-ferrous metallurgy, in particular to anodes for the production of electrolytic aluminium through the electrolysis of fluoride-based melts.

At the moment, aluminium is produced in reduction (electrolysis) cells by the electrolytic decomposition of aluminium oxide ($Al_2O_3$), or alumina, which is dissolved in a melt of fluorides, at about 950° C. This method for aluminium production is called the Hall-Héroult method after its inventors.

Anodes for the electrolysis process are made of carbon, so anodes are continuously consumed as a result of their oxidation by oxygen released upon decomposition of alumina. Due to the use of carbon anodes, reduction cells continuously emit oxides and carbon fluorides, while the use of the self-baking, or Soederberg, technology also leads to emissions of carcinogenic polyaromatic hydrocarbons (PAH) like benz(a)pyrene.

In addition to the above-mentioned environmental problems, the use of consumable carbon anodes does not allow improving the economic indicators of the process since anode manufacturing costs are a significant share in the aluminium production cost. Therefore, ever since the Hall-Héroult method was invented there has been a search for a material of non-consumable, or inert, anodes that release oxygen during the process of electrolysis.

Various classes of inert anodes have been proposed so far: metal, ceramic and cermet. In terms of economic efficiency and technical feasibility, anodes made of metal alloys are the most preferable since they have the lowest cost, high electrical conductivity, ductility and, in the meantime, mechanical strength, and ease of processing and welding.

One of the fundamental differences of inert anodes compared to carbon ones is also that the diameter of oxygen bubbles released on inert anodes is tenths of a millimetre, which is significantly smaller than the diameter of bubbles of CO and $CO_2$ released on carbon anodes. This is due to a lower angle of contact between the bath and the material of inert anodes, compared to carbon. The thickness of the bubble layer and the gas content in the melt under the inert anodes are significantly higher due to the release of a large amount of small oxygen bubbles. Therefore, the voltage drop in the bubble layer under the inert anodes is significantly higher than under the carbon anodes.

Application US 2004/0163967 shows that replacing large cermet anodes having a horizontal working surface by several anodes of a smaller size having an inclined working surface leads to a significant decrease in the cell voltage (as a result of a better escape of oxygen bubbles from under the anode and a decrease in the voltage drop in the bubble layer under the anode).

The physical and mechanical properties of metal anodes allow randomly varying their dimensions and shapes in order to reduce the weight of an anode, optimize bath circulation flows, improve the conditions for gas escape from under the anode and improve the uniformity of alumina dissolution in the bath.

The invention under patent RU 2374362 and applications WO 00/40781, WO 00/40782, WO 03/006716 describe anodes with a number of parallel extended elements separated from each other by longitudinal inter-element gaps. Such design allows oxygen bubbles to escape more quickly from under the anode into the gaps between the anode elements. The anode elements can have the shape of parallel bars, blades, rods in coplanar alignment. The inter-element gaps constitute flow-through openings for bath circulation and the escape of oxygen bubbles. Anodes are additionally equipped with means to speed up the dissolution of the alumina fed; such means represent bath-guiding elements formed out of parallel and inclined deflectors that are separated from each other, located higher above and adjacent to the perforated anode structure.

Oxygen bubbles are generated on the lower surface of the extended anode elements and escape into the inter-element gaps of the perforated anode structure, then, they pass between the inclined deflectors. As a result of such gas escape, the bath circulates upwards and downwards between the inclined deflectors and through the inter-element gaps. The upward-directed flow of the gas and the bath promotes the dissolution of alumina fed unto the open surface of the molten bath. The downward-directed bath flow carries dissolving alumina particles away to the lower working surface of the anode elements. The anode elements with the deflectors are fully submerged into the bath, and only a vertical current conductor or vertical current distributors protrude from the bath.

Application WO 03/006716 describes an improved design of the anode proposed in patent RU 2374362 and applications WO 00/40781 and WO 00/40782. The anode elements of the improved anodes additionally have a cone upper part and an electrochemically active lower part, which is integrated with the upper part. The upper cone part of the anode elements has such a shape as to ensure an upward bath flow along one surface of the upper cone part and a downward flow along its other surface. Such design of the anode elements enables gas escape from under the anode and bath circulation through the anode. To extend the anode service life, it was proposed to manufacture it out of an alloy containing a conductive inert structural metal, such as nickel and/or cobalt, and an active diffusing metal, such as iron that diffuses to the electrochemically active anode surface where it oxidizes ensuring the stability of the electrochemically active anode surface.

It is known an electrolytic cell for aluminium production by the electrolysis of a melt using a perforated vertical anode; see publications of international applications WO 03/074766 and WO 04/104273. These applications also give examples of the material for the perforated anode. In a vertical anode, perforation serves to extract gas from the inter-electrode gap. However, in the case of a vertically located perforated anode, the gas needs to be extracted sideways, and even if the gas is not going sideways, then it will easily escape from the inter-electrode gap upwards. In the case of horizontally located electrodes, such an electrode prevents the gas from going upwards, and it has nowhere else to go from under the anode. Therefore, the problem is more pressing for horizontal electrodes. Besides, vertical anodes need no fins since plate-shaped anodes that protrude from the bath are the fins themselves. The advantages of the proposed invention will be considered in detail below (in the context of the selected prior-art).

Based on the entirety of features, the invention under application WO 03/006716 has been selected as the closest equivalent (or prior-art).

A disadvantage of the prior-art is that an anode with longitudinal anode elements, which are separated from each other, has (compared to a non-perforated anode) a smaller area of the working surface, on which oxygen is released, since a significant part of the anode surface is substituted by inter-element gaps. This leads to an increase in the anode current density and, as a result, an increase in the anode overvoltage and a higher anode consumption, which will not allow reducing the cell voltage and extending the anode service life.

Another disadvantage of the prior-art is that when using such design of anodes there is an issue with the integrity of the crust on the bath surface.

As noted above, when producing aluminium by means of electrolysis, pre-baked carbon anodes are now mainly used; they represent massive bodies in the form of a parallelepiped. Carbon anodes are installed in a cell with small gaps between each other. All anodes, which are installed in a cell, are called the anode carbon. Since the height of the anode carbon is much bigger than the thickness of the molten bath layer, a part of the anode carbon always protrudes from the bath. Therefore, no less than 60% of the area of the cell cavity is occupied by the carbon anodes, and the bath occupies an area in narrow gaps between the anodes, as well as an area along the periphery contained between the anode carbon and the sidewalls of the cell cavity. At the same time, the bath surface is always covered with a crust consisting of solidified bath and alumina. This reduces bath evaporation and energy losses from the cell. The crust is formed and kept over the melt on the anodes protruding from the bath.

When using the anodes as per the prior-art, the main part of such anodes is submerged into the bath melt, from which only current conductors protrude, which occupy a small part of the area of the cell cavity. Therefore, the area of the cryolite-alumina crust is 3 times greater, as compared to a cell with carbon anodes, and such crust will not be able to remain above the bath on the current conductors protruding from it, since it extends quite far and is comparatively low in strength. During cell operation, an alumina layer is accumulated on the crust surface; it is necessary to reduce energy losses through the top side of the cell. As a result of heat insulation, the crust may melt and break. When testing perforated anodes according to the prior-art in a pilot cell, it was observed that the crust periodically collapsed downwards onto the part of the anodes, which was submerged into the bath. As a result, melt circulation through the inter-element gaps is disrupted, the composition and temperature of the bath drastically change, i.e. there is a significant disruption of the aluminium production process.

In patent information sources U.S. Pat. Nos. 5,368,702, 6,402,928, 6,656,340, 6,723,221, WO 02/070784, U.S. Pat. No. 7,749,363, US 2006124471 and RU 2582421, heat insulating covers were proposed to prevent the formation of a crust on the bath surface and reduce heat losses through the top side of the cell. This could solve the problem of possible crust collapses in a situation when perforated anodes are used and only current conductors and/or current distributors of such anodes protrude from the bath. The cover material must be resistant to gaseous fluorine-containing compounds, oxygen and bath drops at high temperatures, as well as to mechanical loads. The cover must ensure low gas permeability, integrity, heat insulation and durability. As of now, no materials meeting all these requirements have been found. The service life of the proposed covers does not exceed several months since the cover material gradually impregnates and interacts with bath vapours during cell operation. This results in the loss of mechanical strength and, ultimately, the destruction of covers. As a consequence, covers require replacement, which leads to an increase in operating costs and the cost of aluminium production. Besides, the components of the cover material constantly end in the bath, get reduced on the cathode and contaminate the aluminium produced.

Therefore for perforated anodes, it is most efficient to develop a method of ensuring a reliable and durable cryolite-alumina crust above the melt surface.

The shared features of the prior-art and the anode under the proposed invention are that the inert metal anode essentially has a perforated structure to speed up the escape of bubbles from under the anode and may be equipped with some means to control bath circulation caused by oxygen bubbles moving upwards (in order to improve alumina dissolution at the bath surface and to deliver the alumina-enriched bath to the lower working surface of the anode). Deflectors and/or the shape of the vertical cross-section of the anode elements may be used as the means to control bath circulation.

The object of this invention is to develop a design of a perforated metal anode to be used for the production of aluminium by the electrolysis of fluoride melts, which will allow reducing the voltage drop in the anode and in the bubble layer under the anode, as well as to reduce the anode overvoltage and anode consumption, as well as to improve current efficiency and the reliability of the cryolite-alumina crust, as compared to the prior-art.

The technical result is to solve the problem in hand, reduce the cell voltage, extend the anode service life, improve current efficiency and ensure that a reliable and durable cryolite-alumina crust is formed above the melt surface.

The problem in hand is solved, and the technical result is achieved, thanks to the fact that an optimal configuration of the metal inert anode has been found to produce aluminium by the electrolysis of a melt, which has multiple electrochemically active anode elements, current distributors and a current conductor. The anode has no less than two vertical or inclined fins protruding from the bath, wherein the anode is intended for horizontal positioning.

The invention is represented by the following particular embodiments of its structural design. The anode has a perforated structure with through-openings, preferably uniformly distributed across the anode; the degree of anode perforation is about 15-35%, preferably about 20%.

The fins are integrated with the current conductor. The vertical or inclined fins serve to form a reliable and durable cryolite-alumina crust above the surface of the bath melt, wherein the preferable height of the fins is such so that they protrude from the bath by about 5-20 cm. After formation, the integrity of the crust is supported by the fins and the current conductor located above the melt surface.

The anode may contain longitudinal and transverse anode elements that intersect with each other and form a perforated anode structure with through-openings limited by the lateral sides of the intersecting anode elements. The fins protruding from the bath may be integrated with the anode elements to improve the strength of the structure and the current distribution across the anode. The anode elements may be made in the form of straight or curved rods, bars or plates with a cross section in the form of a polygon with rounded corners, an ellipse or a circle and be located in the same plane.

It is reasonable when the said longitudinal and transverse anode elements intersect at a right angle; however, the said longitudinal and transverse anode elements may intersect at an angle different from a right one. As a rule, the anode has no less than one current distributor connected to the anode elements. Also, the anode has no less than one current conductor connected to the current distributors.

It is reasonable when the distances between the longitudinal elements and between the transverse anode elements are the same, which will ensure uniform distribution, however, the distances between the longitudinal elements and between the transverse elements may vary. It is possible to vary dimensions depending on process objectives. As a rule, the anode elements have some rounding at the points of intersection. The anode may be made by metal or sand mould casting.

A metal inert anode for the production of aluminium by the electrolysis of a melt, which has multiple electrochemically active anode elements, current distributors and a current conductor, was proposed as one more embodiment of the invention. In the meantime, the anode structure is made in the form of a perforated structure formed by longitudinal and transverse anode elements that intersect each other and are limited by the lateral sides of the intersecting anode elements, as well as contains vertical or inclined fins protruding from the bath, which are integrated with the anode elements or the current conductor, wherein the anode is intended for horizontal positioning. The degree of anode perforation is about 15-35%, the area of an opening is about 10-100 $cm^2$.

The second embodiment of the invention is represented by the following particular embodiments. The degree of anode perforation is preferably about 20%, the area of an opening is about 0.001 $m^2$, the degree of anode perforation is preferably about 20%, the area of an opening is preferably about 50 $cm^2$.

Also, a cell for producing aluminium by the electrolysis of a melt is claimed, which contains any of the configurations of the proposed metal inert anode with horizontal positioning.

BRIEF DRAWING DESCRIPTION

Figure 2:
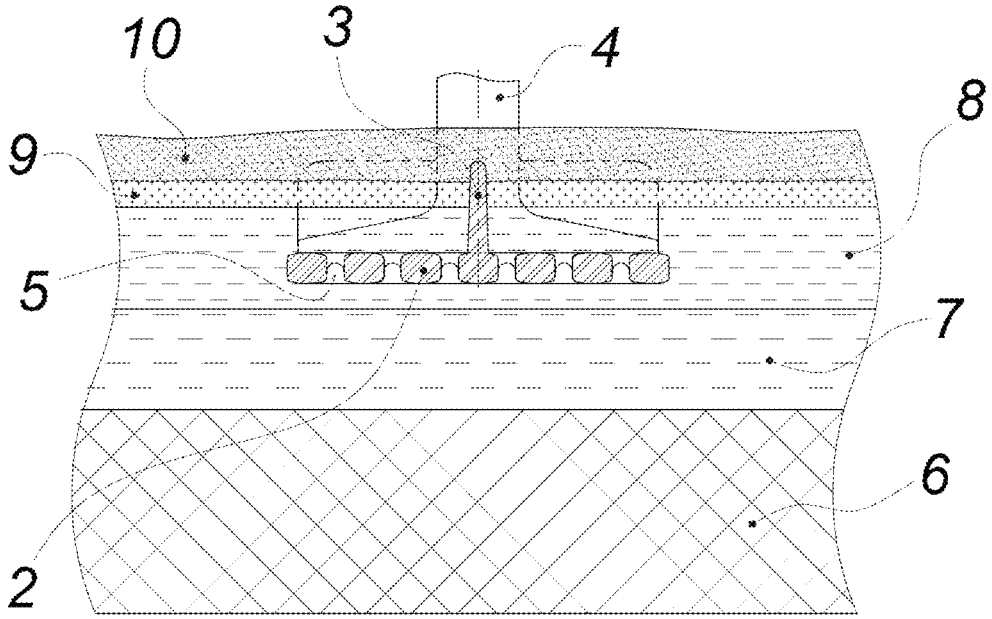

FIG. 1—Example of an embodiment of the perforated anode under the proposed invention; FIG. 2—Example of the installation of the proposed perforated anode in a cell.

FIG. 1 shows a metal inert anode that, according to the invention, has an optimal design, including longitudinal (1) and transverse (2) anode elements, vertical fins (3) and a current conductor (4). The intersecting longitudinal (1) and transverse (2) anode elements in the form of rectangular-sectioned bars form a perforated anode structure with through-openings (5) limited by the lateral sides of the intersecting anode elements. The vertical fins (3) are integrated with the current conductor (4) and the anode elements (1) and (2), which allows improving the strength of the anode structure and the current distribution across the anode.

FIG. 2 shows the metal inert anode of the optimal design installed in a cell for aluminium production. During cell operation, aluminium (7) is deposited and accumulated on its carbon bottom (6), and oxygen bubbles are released on the lower anode surface. Aluminium is deposited and oxygen is released when the direct current passes through the cell as a result of the decomposition of alumina (aluminium oxide) dissolved in the bath melt (8). A cryolite-alumina crust consisting of the crystallized components of the bath and alumina is located above the bath surface (8) with a small gap (9). During the operation of the cell, oxygen bubbles, which release on the lower surface of the elements (2) of the perforated anode, pass via the through-openings (5) and escape into the gap (9) between the bath and the crust (10). In case there are no openings (5), bubbles will accumulate under the anode, which will result in the growth of voltage in the cell and the oxidation of aluminium (7). The elements (2) of the rectangular-sectioned anode are fully submerged into the bath melt, and the fins (3) and the current conductor (4) protrude from the bath. Therefore, the integrity of the crust is supported by the fins (3) and the current conductor (4) above the melt surface. If there are no fins, the crust will collapse downwards on the anode elements (2) submerged into the bath. As a consequence, the openings (5) will be blocked preventing the escape of oxygen bubbles, melt circulation will be disrupted, the cell voltage and the temperature of the molten bath will increase, i.e. there will be a significant disruption of the aluminium production process. The fins (3) are structurally integrated with the anode elements (2) and the current conductor (4). Therefore, the electric current passes from the current conductor (4) via the fins (3) and is uniformly distributed across the anode elements (2) allowing reducing the voltage drop in the anode and the overvoltage of oxygen evolution.

The essence of the invention is that it is proposed to optimize the perforation of the anode to improve the escape of oxygen bubbles from under the anode in order to reduce the cell voltage, thus, to reduce the voltage drop in the bubble layer and, simultaneously, achieve the minimum possible increase in the anode current density (in order to ensure low anode overvoltage, a low voltage drop in the anode and a low anode consumption). The higher is the degree of anode perforation, i.e. the higher is the share of the area occupied by openings, the easier escape gas bubbles from under the anode (from the inter-electrode space), the smaller is the thickness of the bubble layer and the less is the voltage drop therein. Besides, the smaller is the thickness of the bubble layer under the anode, the smaller is the oxygen oxidation of the aluminium metal produced, which is accumulated on the cell bottom and is the cathode. Hence, a decrease in the thickness of the bubble layer increases current efficiency and reduces specific energy consumption.

On the other hand, the higher is the perforation of the anode, the less is the anode surface area and the higher is the anode current density.

It is known that an increase in the anode current density results in an increase in the anode overvoltage and anode consumption.

Besides, an increase in the perforation of the anode leads to an increase in the current density in the anode itself and, consequently, the voltage drop in the anode decreases. This is also accompanied by current distribution deterioration across the anode resulting in changes to the current density in various anode areas and, as a result, non-uniform anode consumption.

Thus, when increasing the degree of perforation, the reduction in the cell voltage will continue until a certain optimal value of the degree of perforation has been achieved. To achieve the technical result, it is necessary to solve the problem of optimizing the degree of anode perforation and the size of openings.

A similar problem was being solved for anodes in cells for the production of chlorine and caustic soda [L. M. Yakimenko. Electrode materials in applied electrochemistry. M., 'Chemistry', 1977, page 264]. In case low-wearing anodes are used in cells with a mercury cathode, and electrodes are positioned horizontally, it is necessary to provide for the drainage of chlorine released on the anode from the zone where the current passes. To this end, various designs of plate electrodes, as well as electrodes made of perforated sheets have been developed. The issue of finding an optimal degree of perforation for a horizontal sheet anode was studied based on a model of a cell with a mercury cathode operating with the use of a NaOH aqueous solution. The dependence of the degree of perforation on voltage was determined for an anode with openings 6-8 mm in diameter. The minimum voltage values were observed at a degree of perforation of 35-40% (at all current density values). Besides, it was established that the slope of the dependence of the cell voltage on the current density also decreases with an increase in the degree of perforation.

At the same degree of anode perforation, as the diameter of perforation openings decreases, the total anode surface (including the internal surface of openings) increases, and the path of gas bubbles from the point of generation to the edge of an opening becomes shorter. Besides, at a smaller diameter of an opening, the electric field between the electrodes is of a more uniform nature, and the effective resistance of the bath is smaller in this case than in the case of a larger diameter of an opening. However, the voltage decreases (as the diameter of openings decreases) only down to a certain point. At small diameters of perforation openings, the hindered gas' ability to escape is explained by the fact that gas bubbles stay in openings due to the surface tension forces forming plugs.

To determine the influence of the diameter of perforation openings on the conditions of gas extraction, the following anodes were studied: anodes with the same degree of perforation (35%) and various diameters of perforation openings, anodes 3 mm thick perforated with openings with a diameter of 2, 4, 6, 8 and 12 mm, and anodes 10 mm thick perforated with openings with a diameter of 4, 6, 8 and 12 mm. The centres of perforation openings are located at the corners of a regular triangular grid (<60°). At an electrode thickness of 3 mm, the smallest voltage values were obtained for a diameter of perforation openings of 4 and 6 mm, and at an anode thickness of 10 mm, such voltage values were obtained for a cell with an anode perforated with openings 6 mm in diameter; the voltage is higher (by 20-40 mV) in cells with anodes perforated with 4- and 8-mm openings. If electrodes have approximately the same voltage, then electrodes perforated with larger diameter openings should be recommended for industrial application (since they are easier to manufacture). For industrial electrodes about 10 mm thick, perforation with openings 6-8 mm in diameter can be recommended; anodes 3-5 mm thick should be perforated with openings about 6 mm in diameter.

A formula was derived to calculate the limit value of the opening diameter, at which the gas might still stay in openings:

$$d_{np} = \sqrt{2.25b^2 + \frac{12\sigma}{\gamma}} - 1.5b$$

where d— the diameter of openings; σ— surface tension of a solution, b — thickness of an anode sheet; γ— solution density.

The σ/γ value for sodium chloride solutions with a concentration of 250-300 g/l varies within 6.0-6.7 $mm^2$ at 60-100° C. The limit values of the diameter of perforation openings for a sheet anode 3 mm thick will be 5.1-5.5 mm under these conditions, and for an anode 10 mm thick they will be 2.2-2.5 mm.

It is apparent that for anodes 10 mm thick the calculated values of the opening diameter significantly differ from the optimal values found in real life. The reason for this is that as the diameter of an opening decreases (and the degree of perforation is the same), there is an increase in the hydrodynamic resistance to the flow of gas bubbles (together with the fluid they are entraining) from under the anode via perforation openings.

The reason for the non-obviousness of the proposed solution is that it is impossible to determine any optimal degree of perforation and the size of openings in an inert anode for producing aluminium by the electrolysis of melts based on the known data since the bath properties (electrical conductivity, viscosity, density, surface tension), the size of bubbles and the hydrodynamics of two-phase flows are very much different.

Besides, it is necessary to consider that the size of openings in an inert anode for aluminium production significantly changes over time since a protective oxide layer is formed and growing on the surface of metal anodes.

To correctly calculate an optimal degree and diameter of perforation, it is also necessary to calculate gas-hydrodynamic circulation flows for a two-phase gas-fluid flow, which is a difficult task related to developing a proper mathematical model and verifying it based on measurement results obtained from real systems and physical models.

Since it is problematic to carry out large-scale experiments in the melt to determine an optimal degree of perforation and the size of openings, simulations (mathematical and physical) are the most rational way of solving the problem related to the reduction of the voltage drop in the anode and in the bubble layer under the anode, as well as to the reduction of anode overvoltage.

Modelling included the development of two- and three-dimensional two-phase models of bubble flows to describe the electric field and the hydrodynamic processes in the inter-electrode space of the cell, including gas evolution on the anode: electrochemical processes of gas formation on the surface of an inert anode, two-phase models of a bubble flow, models of the electric field in the working zone of the cell with consideration of the amount of gas in the bath.

Thus, the developed mathematical model is based on a system of two coupled elliptical equations for the electric potential and GVF (gas volume fraction) and hydrodynamics equations (equations for velocity components and a continuity equation). The system of equations is coupled. In particular, the electric field depends on the gas content; the gas content depends of the flow of the gas-filled bath, etc. The system of equations is non-linear.

For implementing the said mathematical model of gas evolution on the anode in an aluminium reduction cell, a computational algorithm was developed for solving a two- and three-dimensional stationary problem related to the gas content, which is based on finite element approximation in space and the iterative solution of a nonlinear coupled system of equations by the Newton method.

Calculations were made with the use of the application software developed. The model was verified based on the results of measuring the gas content and the size of bubbles in an experimental electrolytic cell. The perforation of an inert anode was optimized based on the results of multiple-parameter three-dimensional calculations (which were based on grid models, considering the real geometry of an inert anode) made with the help of the application software developed. For the calculations, the anode size was set to be 1×1 $m_2$ and 0.06 m thick. The anode is uniformly perforated in two directions with circular-sectioned openings. The calculations were made at the distance between the anodes equal to 0.1 m in transverse direction and equal to 0.2 m in longitudinal direction. The distance between the anodes and the cell sidewall was taken to be equal to 0.2 m. The inter-electrode distance was 0.06 m.

The optimality criterion was the current (amperage) passing through the anode at the fixed voltage drop, in fractions, with respect to the anode without perforation and without considering the gas content of the bath ($I_0$). The smaller is this parameter, the worse, since the cell voltage will be higher at the same amperage.

The following parameters were selected as variable: the number of openings 36-100, the degree of perforation 0-30% and the diameter of circular-shaped openings 0.04-0.10 m:

| Number of openings | Degree of perforation % (d, m) | I/Io (w/o the gas content in the bath) | I/Io (with the gas content in the bath) |
|---|---|---|---|
| 0 | 0% | 1.000 | 0.246 |
| 36 | 4.5% (0.04) | 0.999 | 0.926 |
| 6 × 6 | 10% (0.06) | 0.994 | 0.944 |
| | 18% (0.08) | 0.985 | 0.960 |
| | 28% (0.10) | 0.970 | 0.956 |
| 64 | 8% (0.04) | 0.998 | 0.962 |
| 8 × 8 | 20% (0.06) | 0.990 | 0.973 |
| | 32% (0.08) | 0.973 | 0.965 |
| 100 | 12.6% (0.04) | 0.996 | 0.979 |
| 10 × 10 | 19.6% (0.05) | 0.991 | 0.980 |
| | 28.3% (0.06) | 0.984 | 0.976 |

It is evident from the table above that if the gas content in the bath is not taken into account, then the anode perforation leads to a decrease in the amperage, which is due to the growth of the voltage drop in the anode because of a decrease in the area of the anode. However, under conditions of gas evolution, the current (amperage) on a non-perforated anode is reduced about 4 times (due to an increase in the voltage drop in the gas-filled layer of the bath under the anode). Under conditions of gas evolution under the anode (for increasing the amperage passing through an anode), the optimal degree of perforation is 20%, and the optimal diameter of an opening is about 0.04 m, which corresponds to an opening area of about 0.001 $m^2$, taking into account that the shape of an opening may differ from a round one.

Despite the fact that the optimization, for the sake of simplicity, was carried out for round openings, the shape of openings may be in the form of a polygon with rounded corners, whose area and dimensions approximately correspond to the area and diameter of round openings.

An additional feature of the invention is that vertical or inclined fins are provisioned in the design of the perforated metal anode (whose main part is submerged into the bath) in order to form a reliable and durable cryolite-alumina crust. The optimal height of these fins is such that they protrude from the bath to a height of about 5-20 cm. Thus, when using the proposed anodes, not only the anode current conductors protrude from the bath but also the fins. This allows shortening the distance between the anode elements protruding from the bath. Thus, the fins divide the crust into small areas, which reduces the risk of its collapse. Besides, the protruding fins promote crust strengthening since they carry the heat away and reduce the crust temperature near the fins. Therefore, the risk of crust melting and collapsing is reduced.

The anode fins are integrated with the anode current conductor and/or the perforated part of the anode. When the fins are simultaneously integrated with both the anode current conductor and the perforated part of the anode, it leads to a better structural integrity of the anode and a better current distribution across the anode, but, in the meantime, the anode weight and material consumption become higher. When increasing the number of fins, crust reliability will also be increased since the distance between the fins is shorter and, accordingly, the crust extension is less, as a result, the crust is better cooled and, hence, stronger.

The fins can also serve to control bath circulation flows caused by the movement of oxygen bubbles upwards (for the purpose of improving the dissolution of alumina at the bath surface and delivering the alumina-enriched bath to the lower working surface of the anode). To this end, the angle of inclination and the location of the fins may vary to ensure a directed movement of the bath to the alumina feeding points.

Industrial tests of the perforated anodes with the fins, compared to the anodes under the prior-art, have showed that the proposed design solutions are efficient in terms of reducing the cell voltage and ensuring a reliable crust above the bath.

What is claimed is:

1. A metal inert anode for producing aluminium by the electrolysis of a melt which has multiple electrochemically active anode elements, current distributors and a current conductor, wherein:

the anode contains no less than two vertical or inclined fins protruding from the bath, the anode is designed to be positioned horizontally, and the anode is made in a form of a perforated structure with through-openings distributed across the anode, the degree of anode perforation being 15-35% such that an area of a through-opening is 10-100 $cm^2$.

2. The anode of claim 1, wherein the degree of anode perforation is about 20%.

3. The anode of claim 1, wherein the no less than two vertical or inclined fins are integrated with the current conductor.

4. The anode of claim 1, wherein the no less than two vertical or inclined fins support formation of a reliable and durable cryolite-alumina crust above a surface of the melt, wherein a height of the no less than two vertical or inclined fins is such that they protrude from the bath by about 5-20 cm.

5. The anode of claim 4, wherein an integrity of the reliable and durable cryolite-alumina crust is supported by the no less than two vertical or inclined fins and the current conductor located above the melt surface.

6. The anode of claim 1, wherein the anode contains longitudinal and transverse anode elements intersecting each other and forming a perforated anode structure with through-openings limited by lateral sides of the intersecting anode elements.

7. The anode of claim 6, wherein the no less than two vertical or inclined fins protruding from the bath are integrated with the anode elements.

8. The anode of claim 6, wherein the anode elements are made in a form of straight or curved rods, bars or plates with a cross section in a form of a polygon with rounded corners, an ellipse, or a circle and are located in the same plane.

9. The anode of claim 6, wherein the longitudinal and transverse anode elements intersect at a right angle.

10. The anode of claim 6, wherein the longitudinal and transverse anode elements intersect at an angle different from a right angle.

11. The anode of claim 6, wherein the anode has no less than one current distributor connected to the anode elements.

12. The anode of claim 11, wherein the anode has no less than one current conductor connected to the current distributors.

13. The anode of claim 6, wherein the distances between the longitudinal anode elements and between the transverse anode elements are the same.

14. The anode of claim 6, wherein the distances between the longitudinal anode elements and between the transverse anode elements are different.

15. The anode of claim 6, wherein the anode elements have rounding at the points of intersection.

16. The anode of claim 1, wherein the anode is manufactured by metal or sand mould casting.

17. A metal inert anode for producing aluminium by the electrolysis of a melt, which has multiple electrochemically active anode elements, current distributors and a current conductor, wherein:

the anode is made in the form of a perforated structure formed by longitudinal and transverse anode elements intersecting each other and limited by lateral sides of the intersecting anode elements, the anode contains vertical or inclined fins that protrude from the bath and are integrated with the anode elements or the current conductor, the anode is designed to be positioned horizontally, the degree of anode perforation being about 15-35% such that an area of the anode perforation is about 10-100 $cm^2$.

18. The anode of claim 17, wherein:

the degree of anode perforation is preferably 20% with the area of an opening being about 0.001 $m^2$ or the degree of anode perforation is preferably about 20%, with the area of an opening being preferably about 50 $cm^2$.

19. A cell for producing aluminium by the electrolysis of a melt, which contains a metal inert anode, wherein the metal inert anode is an anode made according to any one of claims 1-18.

* * * * *